US008063830B2

(12) United States Patent
Yoshioka et al.

(10) Patent No.: US 8,063,830 B2
(45) Date of Patent: Nov. 22, 2011

(54) ANTENNA DEVICE

(75) Inventors: Masahiro Yoshioka, Tokyo (JP); Masato Kikuchi, Tokyo (JP); Shunsuke Mochizuki, Tokyo (JP); Ryosuke Araki, Tokyo (JP); Masaki Handa, Kanagawa (JP); Takashi Nakanishi, Tokyo (JP); Hiroto Kimura, Tokyo (JP); Seiji Wada, Kanagawa (JP); Hiroshi Ichiki, Kanagawa (JP); Tetsujiro Kondo, Tokyo (JP)

(73) Assignee: Sony Corporation, Tokyo (JP)

( * ) Notice: Subject to any disclaimer, the term of this patent is extended or adjusted under 35 U.S.C. 154(b) by 394 days.

(21) Appl. No.: 12/324,980

(22) Filed: Nov. 28, 2008

(65) Prior Publication Data

US 2009/0146886 A1 Jun. 11, 2009

(30) Foreign Application Priority Data

Dec. 11, 2007 (JP) ..... 2007-319568

(51) Int. Cl.
*H01Q 1/38* (2006.01)

(52) U.S. Cl. ..... 343/700 MS; 343/829; 343/846; 343/893

(58) Field of Classification Search ..... 343/700 MS, 343/846, 893
See application file for complete search history.

(56) References Cited

U.S. PATENT DOCUMENTS

| | | | | |
|---|---|---|---|---|
| 6,809,687 | B2 * | 10/2004 | Yuanzhu | 343/700 MS |
| 7,450,072 | B2 * | 11/2008 | Kim et al. | 343/700 MS |
| 7,817,094 | B2 * | 10/2010 | Adachi et al. | 343/702 |
| 2005/0253756 | A1 | 11/2005 | Kuroda et al. | |

FOREIGN PATENT DOCUMENTS

| | | |
|---|---|---|
| JP | 2001-168629 | 6/2001 |
| JP | 2003-347828 | 12/2003 |
| JP | 2005-72675 | 3/2005 |
| JP | 2005-278067 | 10/2005 |
| JP | 2007-288649 | 11/2007 |
| WO | WO 00/03453 | 1/2000 |
| WO | WO 02/054536 A1 | 7/2002 |

OTHER PUBLICATIONS

U.S. Appl. No. 12/273,038, filed Nov. 18, 2008, Kikuchi, et al.
Japanese Office Action issed Sep. 6, 2011 in Japanese Patent Application No. 2007-319568 filed Dec. 11, 2007.

* cited by examiner

*Primary Examiner* — Trinh Dinh
(74) *Attorney, Agent, or Firm* — Oblon, Spivak, McClelland, Maier & Neustadt, L.L.P.

(57) ABSTRACT

A planar antenna device is mounted on a board including a dielectric layer and two conductor layers vertically sandwiching the dielectric layer. The upper conductor layer includes a first radiating element having an end portion connected through a via hole to a ground formed by the lower conductor layer, a second radiating element having an open end portion, first and second ground conductors connected to respective base portions of the first and second radiating elements via resistors, and a feeder line configured to feed power to the first and second radiating elements.

3 Claims, 8 Drawing Sheets

ANTENNA DEVICE

CROSS REFERENCES TO RELATED APPLICATIONS

The present invention contains subject matter related to Japanese Patent Application JP 2007-319568 filed in the Japanese Patent Office on Dec. 11, 2007, the entire contents of which are incorporated herein by reference.

BACKGROUND OF THE INVENTION

1. Field of the Invention

The present invention relates to an antenna device used to transmit and receive a radio signal, and particularly to an antenna device formed by simple combination of planar conductors including a radiating conductor and a ground conductor disposed to face each other with an insulating material interposed therebetween.

More specifically, the present invention relates to an antenna device of a planar structure mountable on a common printed board material or the like of a multilayer structure including layers of a conductor, a dielectric material, and a conductor, for example, and particularly to an antenna device of a planar structure which reduces the area of radiating conductors thereof and exhibits a wide band characteristic.

2. Description of the Related Art

In wireless communication using a radio wave communication method, a signal is transmitted with the use of a radiation field generated upon passage of current through an aerial (an antenna). The antenna has a variety of types. An antenna having a wide band characteristic can be used in communication which transmits and receives signals by diffusing the signals over an ultra wide frequency band such as a UWB (Ultra Wide Band). Further, a small-size antenna contributes to a reduction in size and weight of a wireless device.

In particular, an antenna configuration satisfying a request for a thinner antenna includes an antenna device configured such that a radiating conductor and a ground conductor plate are disposed to face each other with an insulating material interposed therebetween, i.e., a microstrip patch antenna (hereinafter abbreviated simply as the patch antenna). The shape of the radiating conductor is not particularly determined, but is rectangular or circular in most cases. The thickness of the insulating material interposed between the radiating conductor and the ground conductor plate is generally set to be equal to or less than one tenth of the wavelength of a radio frequency. Thus, the patch antenna can be formed into a substantially thin shape. Further, the patch antenna can be manufactured by an etching process performed on an insulating material substrate copper-clad on both sides thereof, and thus can be manufactured with relative ease. That is, it is relatively easy to manufacture the patch antenna.

For example, a magnetic microstrip patch antenna has been proposed in which short-circuiting conductor plates for making a radiating conductor and a ground conductor conductive are appropriately disposed at respective positions for suppressing excitation in an undesired mode, to thereby suppress disturbance in a radiation pattern at an end of a band, and in which a magnetic material having a relative permittivity of one or higher and having a multilayer structure including alternate lamination of a magnetic layer and an air layer is used to fill the gap between the radiating conductor plate and the ground conductor plate, to thereby realize unidirectivity in a wide bandwidth (see US Patent Application No. 2005/253756, for example).

A normal printed board has a structure in which a thin dielectric plate is vertically sandwiched by two conductor plates. If the printed board is structured such that the lower conductor plate is used as a ground (GND), and that the upper conductor plate is formed into a rectangular or circular shape and fed with electric power, a patch antenna can be formed and easily integrated with the circuit board.

FIGS. 10 and 11 illustrate a typical configuration example of the patch antenna formed on the printed board (FIG. 10 is a cross-sectional view of the patch antenna as viewed from a side, while FIG. 11 is a view of the patch antenna as viewed from obliquely above). In the printed board, the conductor layers 101 and 103 and 203 and 201 include copper or silver, for example, and the dielectric layer 102 and 202 includes a glass epoxy resin or Teflon (a registered trademark), for example. In the board structure as illustrated in FIGS. 10 and 11, in which the dielectric layer 102 and 202 is sandwiched by the conductor layers 101 and 103 and 203 and 201, a double-sided board is used. Alternatively, a multilayer board (e.g., alternate lamination of a conductor and a dielectric material) can also be used.

As illustrated in the drawings, the patch antenna can be viewed as an unbalanced feeding planar antenna, and is normally designed with an antenna formed by the upper conductor plate (a radiating element) regarded as a resonator. Further, current flowing along an end edge of the conductor plate is considered to be equal to current flowing through a parallel transmission line 104 extending across the dielectric material. Therefore, the patch antenna has a wavelength reduction effect according to the relative permittivity of the dielectric material. If it is assumed that a length L of the radiating element is equal to a width W of the radiating element, the patch antenna is designed on the basis of the following Equation (1).

$$L = W = \frac{\lambda}{2\sqrt{\varepsilon_{eff}}} = \frac{\lambda_g}{2} \tag{1}$$

Herein, $\in_{eff}$ represents the effective permittivity of the dielectric substrate, and $\lambda_g$ represents the effective wavelength. The effective permittivity $\in_{eff}$ can be determined on the basis of the permittivity and a thickness h of the dielectric substrate and the value of the width W of the antenna (=the length L of the antenna). It is understood from the above Equation (1) that, if the length or width of the antenna (the radiating element) is reduced to half the effective wavelength $\lambda_g$, resonance occurs to radiate radio waves of a resonance frequency. Further, if a feeding point 204 is provided at a position offset from the center of the radiating element having the size W×L, the impedance matching can be achieved.

The effective permittivity $\bigstar_{eff}$ of the dielectric substrate can be determined on the basis of the permittivity and the thickness h of the substrate and the value of the width W of the radiating element. Therefore, if the permittivity of the dielectric substrate is increased, the patch antenna can be reduced in size due to the wavelength reduction effect.

However, there is a limitation to the permittivity. Practically, it is necessary for the patch antenna to occupy an area of the size W×L on the printed board. This is because, in the patch antenna, the width W is increased to reduce the impedance of the antenna and thereby widen the band of the antenna. Therefore, the area of the antenna is increased.

Further, a planar patch antenna including a ground on the back surface thereof on a dielectric multilayer board generally has a narrow band (Current flowing along an end edge of a conductor plate forming a radiating element is considered to be equal to current flowing through a parallel transmission line extending across a dielectric layer. Further, the wavelength of the current is dominated by the relative permittivity of the dielectric material. That is, the frequency band of transmittable and receivable radio waves is limited to a narrow range dominated by a predetermined permittivity of the dielectric material). Frequency components which can be radiated by the patch antenna include a frequency f determined by the following Equation (2) on the basis of the effective wavelength $\lambda_g$ described in the above Equation (1) and a higher harmonic component thereof. The frequency components do not represent a wide band.

$$f = \frac{c}{\lambda_g} \tag{2}$$

In many of wireless communication techniques in the past, which assume long-distance communication, it suffices if only the behavior of the antenna in a far field is taken into account. In recent years, however, there have been increasing cases assuming close-range communication. Thus, it has been becoming necessary to understand phenomena occurring in a near field of the antenna, in which the communication distance is equal to or shorter than the wavelength.

It is now assumed that communication systems of recent years are divided into narrow band communication and wide band communication. The patch antenna generally tends to operate in a narrow band, and thus is considered to be unsuitable for, for example, a PAN (Personal Area Network) system, the operable band of which is necessary to be wide. Bandwidths having a VSWR (Voltage Standing Wave Ratio) of two or less are generally on the order of a few percent, depending on a design parameter. Due to this disadvantage, it is difficult to use the patch antenna in the wide band communication.

If the ground is provided on the back surface of the antenna on the dielectric multilayer board, the band of the antenna is narrowed. To ensure the wide band characteristic in the patch antenna of the related art, therefore, a structure not including the ground on the back surface of the antenna is generally employed. In such a case, however, the structure of a housing of an electronic device is complicated in design.

SUMMARY OF THE INVENTION

It is desirable to provide an antenna device of a superior planar structure mountable on a common printed board material having a multilayer structure including layers of a conductor, a dielectric material, and a conductor.

It is further desirable to provide an antenna device of a superior planar structure capable of reducing the area of radiating conductors thereof and exhibiting a wide band characteristic.

The present invention has been made with the above issues taken into account. A planar antenna device according to an embodiment of the present invention is mounted on a board including a dielectric layer and two conductor layers vertically sandwiching the dielectric layer. The upper conductor layer includes a first radiating element having an end portion connected through a via hole to a ground formed by the lower conductor layer, a second radiating element having an open end portion, first and second ground conductors connected to respective base portions of the first and second radiating elements via resistors, and a feeder line configured to feed power to the first and second radiating elements. It is assumed herein that the first and second radiating elements are connected to the feeder line via the respective resistors each having an appropriate resistance value in consideration of the impedance of the feeder line.

As an antenna device satisfying a request for a thinner antenna, a patch antenna has been known. In a normal printed board having a structure in which a thin dielectric plate is vertically sandwiched by two conductor plates, if the lower conductor plate is used as a ground, and if the upper conductor plate is subjected to processing such as etching to form a radiating element, a patch antenna can be manufactured.

However, an effective wavelength $\lambda_g$ of the patch antenna is determined by a conductor size, i.e., a width W and a length L of the radiating conductor. Therefore, the patch antenna generally tends to operate in a narrow band, and thus is considered to be unsuitable for wide band communication. Further, in recent years, opportunities for close-range communication have been increasing. Therefore, it is necessary to understand phenomena occurring in a near field of the antenna, in which the communication distance is equal to or shorter than the wavelength.

Meanwhile, the antenna device according to the embodiment of the present invention, which is configured to include a dielectric layer and two conductor layers vertically sandwiching the dielectric layer similarly as in the patch antenna, the lower conductor layer is used as the ground, and the upper conductor layer is formed into the first and second radiating elements, which function as an open end and a ground end, respectively, and operate inversely to each other in response to a change in frequency.

When the antenna is viewed as a transmission line, it is necessary to provide impedance matching over a wide band and thereby prevent reflection to widen the band of the antenna, from the perspective of electric power transmission. In the antenna device according to the embodiment of the present invention, the first and second radiating elements form an LC (inductance-capacitance) circuit, and thus can be employed as an impedance converter. In a configuration including only the first radiating element functioning as the open end, a change in the used band causes a change in the impedance. As a result, an impedance mismatch occurs. Meanwhile, if the first radiating element is combined with the second radiating element functioning as the ground end, the change in the impedance is offset. Accordingly, an effect of maintaining the impedance match is expected over a wide band.

Herein, a common length L of each of the first and second radiating elements for enabling the radiating elements to operate as the LC resonant circuit is one quarter of an effective wavelength $\lambda_g$. Further, a width W of each of the first and second radiating elements is sufficient if the width W is equal to or greater than a line width with which the radiating elements achieve the impedance matching as the LC circuit.

If a general antenna is configured to perform the impedance matching by using a radiating element thereof, the antenna is difficult to operate in a wide band. Further, in the patch antenna of the related art, the line width W of the radiating element is increased to reduce the impedance of the radiating element and thereby widen the band of the antenna. Therefore, the area of the antenna is increased. Meanwhile, in the planar antenna according to the embodiment of the present invention, the two radiating elements, which function as the open end and the ground end, respectively, and operate inversely to each other in response to a change in frequency, are combined to form the LC circuit. Further, the line width W can be determined such that the impedance matching is achieved with an impedance $Z_{trans}$ of the thus formed LC circuit. That is, it is unnecessary to increase the line width W of the radiating elements to widen the band of the antenna. Accordingly, the planar antenna can reduce the area of the radiating conductors and exhibit the wide band characteristic.

The present invention can provide an antenna device of a superior planar structure mountable on a common printed board material having a multilayer structure including layers of a conductor, a dielectric material, and a conductor.

The present invention can further provide an antenna device of a superior planar structure capable of reducing the area of radiating conductors thereof and exhibiting the wide band characteristic.

The antenna device according to the embodiment of the present invention is a planar antenna mounted on a printed board material. The antenna device includes two radiating elements each having a length shorter than one quarter of the wavelength determined by the lowest frequency of the transmission band. Therefore, the area occupied by the antenna can be reduced more in the antenna device according to the embodiment of the present invention than in the patch antenna of the related art having a size W×L determined by the effective wavelength $\lambda_g$.

Herein, one of the radiating elements has an end connected to the ground, and the other radiating element has an open end. If the width of each of the radiating elements is set to be less than half the line width for feeding power, the effect of reducing the area occupied by the antenna can be further enhanced.

If the antenna device according to the embodiment of the present invention is used to form a wireless communication device, the wireless communication device can be used to perform high-speed and large-volume communication in communication systems of recent years requested to perform wide band communication at a short distance.

Further purposes, features, and advantages of the present invention will become apparent by reference to further detailed description based on an embodiment of the present invention and the accompanying drawings described later.

DESCRIPTION OF THE PREFERRED EMBODIMENTS

An embodiment of the present invention will be described in detail below with reference to the drawings.

Figure 1:
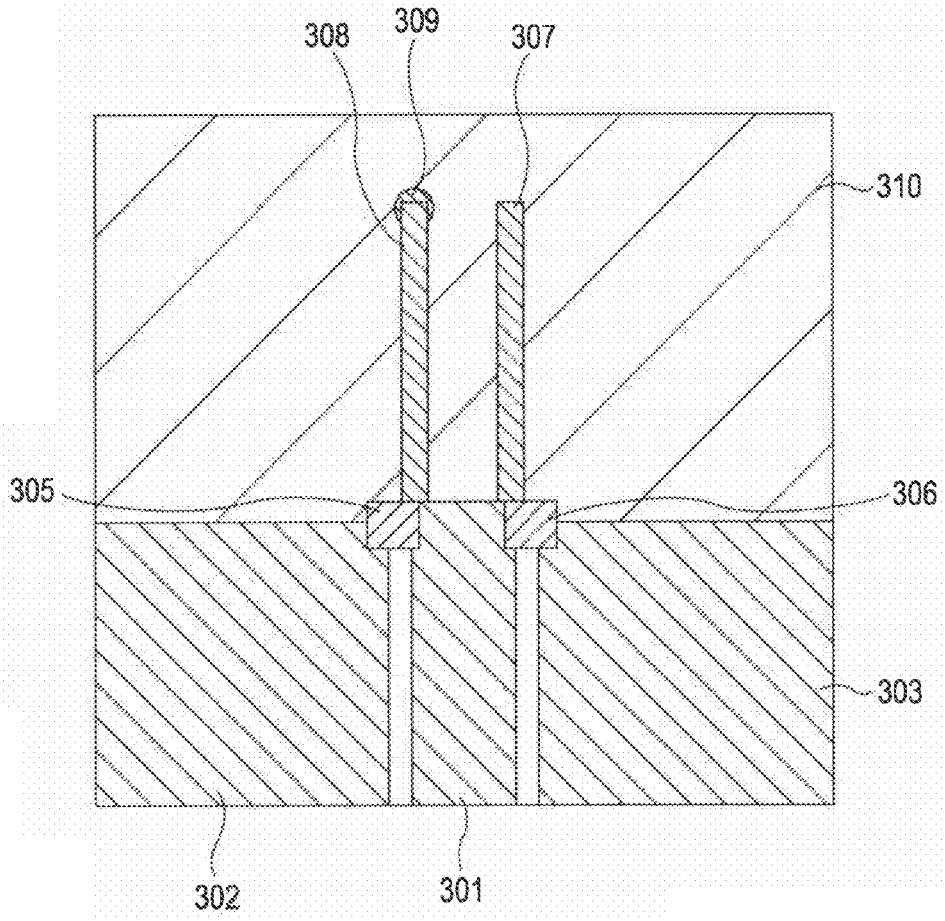
FIG. 1 is a diagram illustrating a configuration example of a non-contact communication system using electric field coupling employing an electrostatic field or an induced electric field.

FIG. 1 illustrates an antenna device according to an embodiment of the present invention, as viewed from above. The antenna device illustrated in the drawing is configured to include two radiating elements 307 and 308, a via hole 309 through which an end of one of the radiating elements 308 is connected to a lower ground (not illustrated), ground conductors 303 and 302 connected to respective base portions of the radiating elements 307 and 308 via resistors 306 and 305, and a feeder line 301 which feeds power to the radiating elements 307 and 308. Similarly to a patch antenna, the antenna device is a planar antenna mountable on a printed board including a thin dielectric layer vertically sandwiched by two conductor layers. The conductor layers include copper or silver, for example, and the dielectric layer 310 includes a glass epoxy resin or Teflon (a registered trademark), for example. Further, the feeder line 301 includes a microstrip line, a coplanar line, or a coaxial cable, for example.

Figure 2:
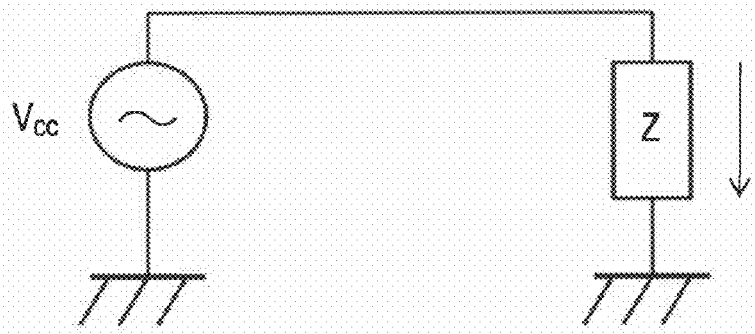
FIG. 2 is a diagram illustrating an abstracted transmission line.

FIG. 2 illustrates an abstracted transmission line. As illustrated in the drawing, the transmission line includes a signal source $V_{cc}$ and a load impedance Z. Signal current I flows into the ground via the load impedance Z. It is known that ideal electric power transmission is achieved if the load impedance Z is equalized to an impedance $Z_{cc}$ of the signal source $V_{cc}$. When the antenna is viewed as one transmission line, the load impedance Z is considered to be a vacuum impedance (120π [Ω]).

Figure 3:
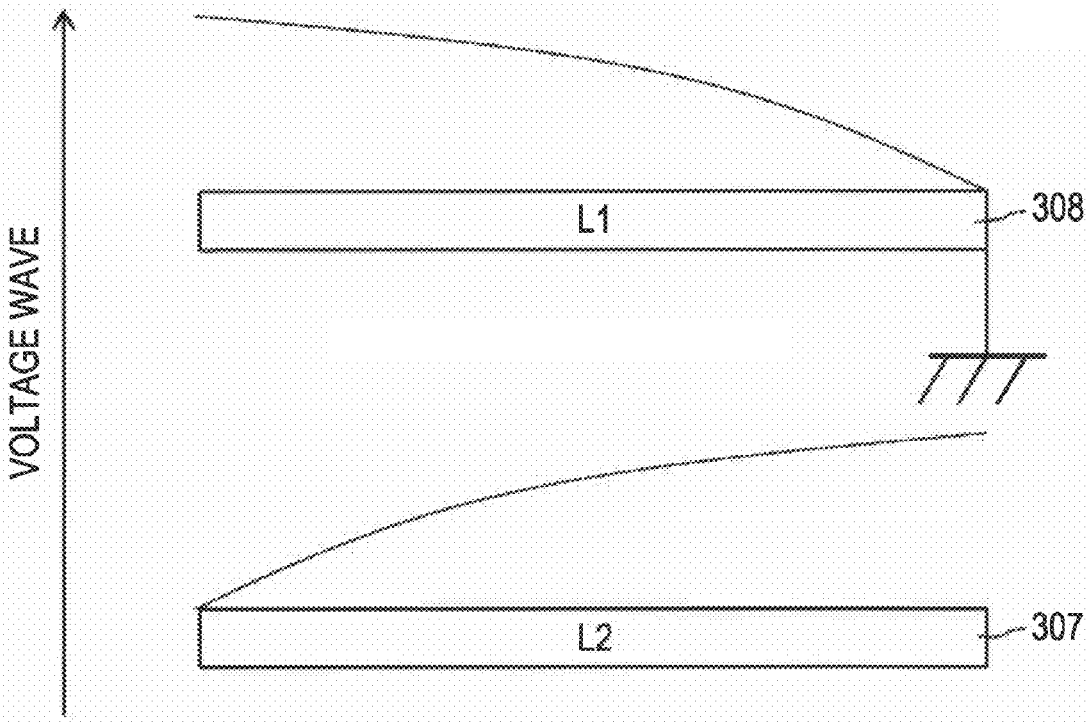
FIG. 3 is a diagram illustrating the state of a voltage wave generated in respective radiating elements.
Figure 4:
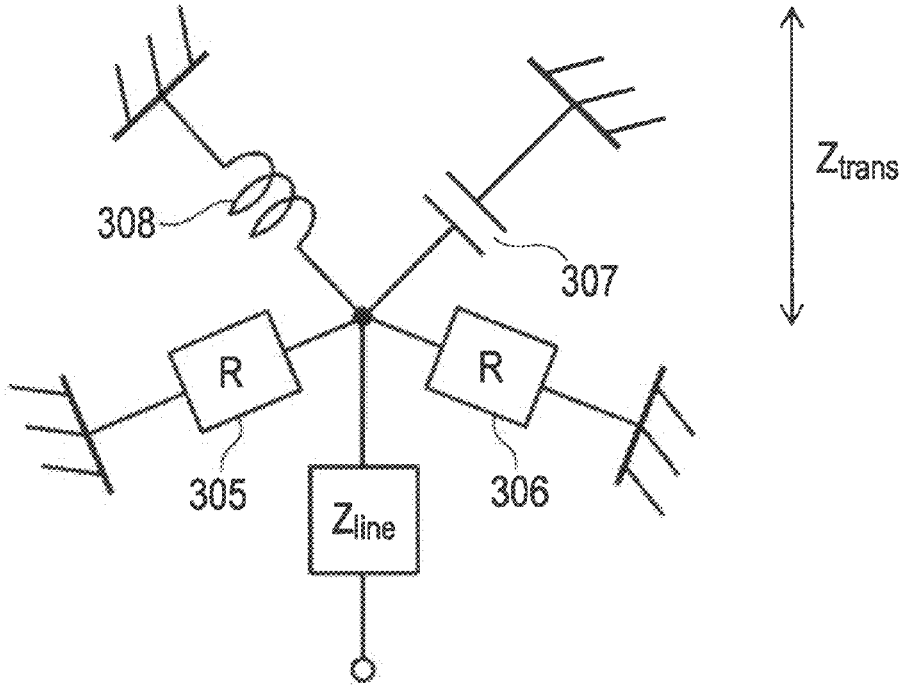
FIG. 4 is a diagram illustrating an equivalent circuit of a planar antenna illustrated in FIG. 1.

In the planar antenna illustrated in FIG. 1, one of the radiating elements 307 is formed by a stub functioning as an open end, and is considered to act as a capacitance C formed between the radiating element 307 and the lower ground conductor. Meanwhile, the other radiating element 308 is formed by a stub functioning as a ground end, and is considered to act as an inductance L. FIG. 3 illustrates the state of a voltage wave generated in the radiating elements 307 and 308. That is, an equivalent circuit of the planar antenna illustrated in FIG. 1 is configured as illustrated in FIG. 4, wherein the two radiating elements 307 and 308 form an LC resonant circuit.

Figure 5:
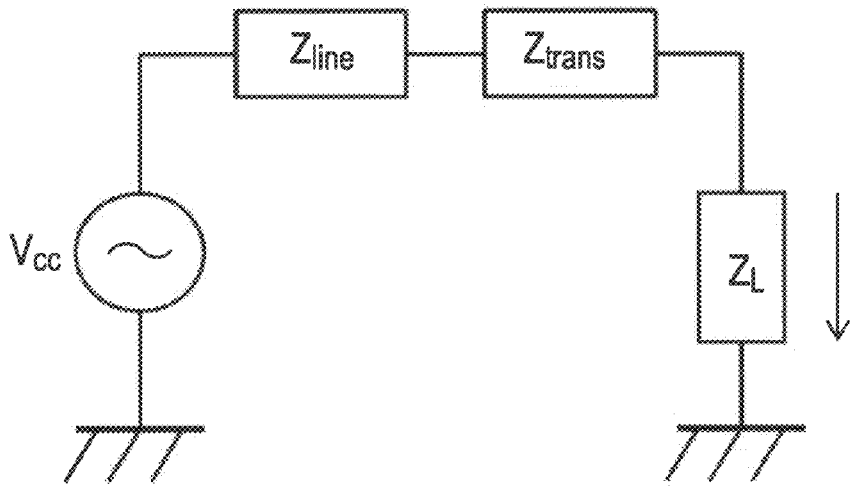
FIG. 5 is a diagram illustrating the planar antenna illustrated in FIG. 1 as a transmission line.

Herein, if the impedance of the antenna which can be viewed as the LC circuit is represented as $Z_{trans}$, the planar antenna illustrated in FIG. 1 can be considered to be a transmission line as illustrated in FIG. 5, wherein $Z_{line}$ represents the impedance of the feeder line 301 including a coplanar line or the like (=50[Ω]), and $Z_L$ represents the vacuum impedance (=120π[Ω]).

From the perspective of electric power transmission, it is necessary in the transmission line illustrated in FIG. 5 to provide impedance matching over a wide band and thereby prevent reflection. The two radiating elements 307 and 308 form the LC circuit, and thus can be employed as an impedance converter. That is, the following Equation (3) holds.

$$Z_{trans}^2 = Z_{line} \times Z_L \quad (3)$$

If $Z_{line}$=50[Ω] and $Z_L$=120π[Ω] are substituted in the above Equation (3), the impedance $Z_{trans}$ of the antenna is preferably approximately 137[Ω] in a wide band, as shown below.

$$Z_{trans}=\sqrt{6000\pi}\approx 137[\Omega] \quad (4)$$

The two radiating elements 307 and 308 form the impedance converter. Referring again to FIG. 1, one of the radiating elements 307 functions as the open end. In a configuration including only the radiating element 307, a change in the used band causes a change in the impedance. Meanwhile, if the radiating element 307 is combined with the radiating element 308 functioning as the ground end, the change in the impedance is offset due to the operation of the radiating element 308 in response to a change in frequency, which is inverse to the operation of the radiating element 307. Accordingly, an effect of maintaining the impedance $Z_{trans}$ of the antenna substantially constant is expected over a wide band.

A commonly length L of each of the two radiating elements 307 and 308 for enabling the radiating elements to operate as the LC resonant circuit is one quarter of an effective wavelength $\lambda_g$. Further, a width W of each of the two radiating elements 307 and 308 can be set to be a line width $w_{137}$ with which the impedance $Z_{trans}$ of the LC resonant circuit is approximately 137[Ω].

Figure 10:
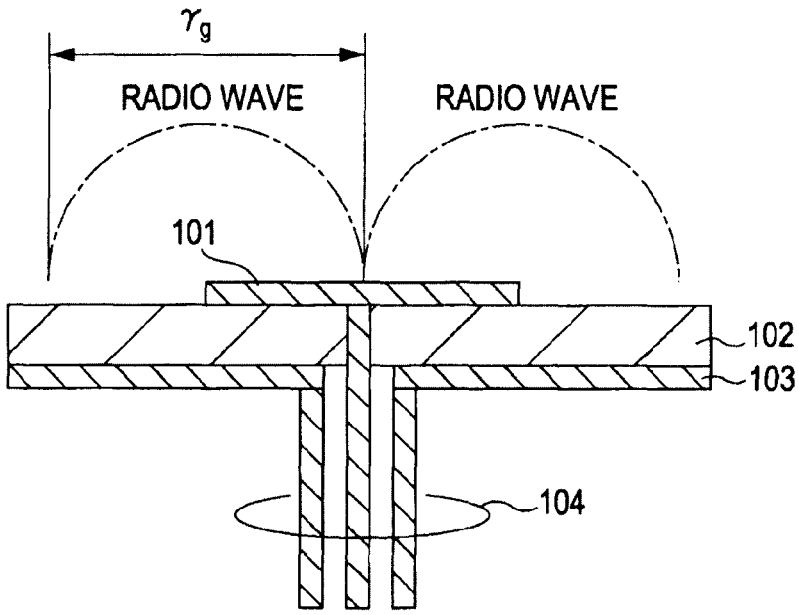
RELATED ART FIG. 10
FIG. 10 is a diagram illustrating a typical configuration example of a patch antenna formed on a printed board (the related art)
Figure 11:
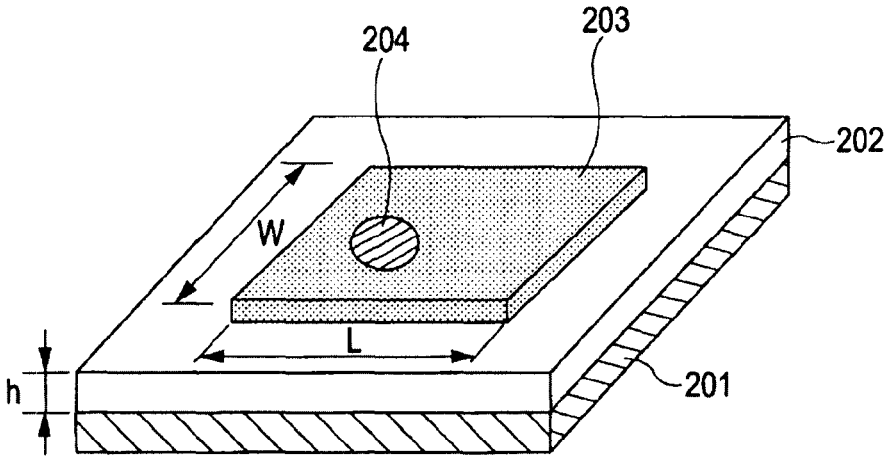
RELATED ART FIG. 11
FIG. 11 is a diagram illustrating the typical configuration example of the patch antenna formed on the printed board (the related art).

In a general antenna, the impedance matching is performed with the impedance $Z_{trans}$. Thus, the general antenna is unsuitable to operate in a wide band. Further, in the patch antenna of the related art (see FIGS. 10 and 11), the line width W of the radiating element is increased to reduce the impedance $Z_{trans}$ and thereby widen the band of the patch antenna. This configuration, however, increases the area of the patch antenna. Meanwhile, in the planar antenna according to the present embodiment, the two radiating elements 307 and 308, which function as the open end and the ground end, respectively, and operate inversely to each other in response to a change in frequency, are combined to form the LC circuit. Further, the line width W can be determined such that the impedance matching is achieved with the impedance $Z_{trans}$ of the thus formed LC circuit. That is, it is unnecessary to increase the line width W of the radiating elements to widen the band of the antenna. In other words, the planar antenna can reduce the area of the radiating conductors and exhibit a wide band characteristic.

Figure 6:
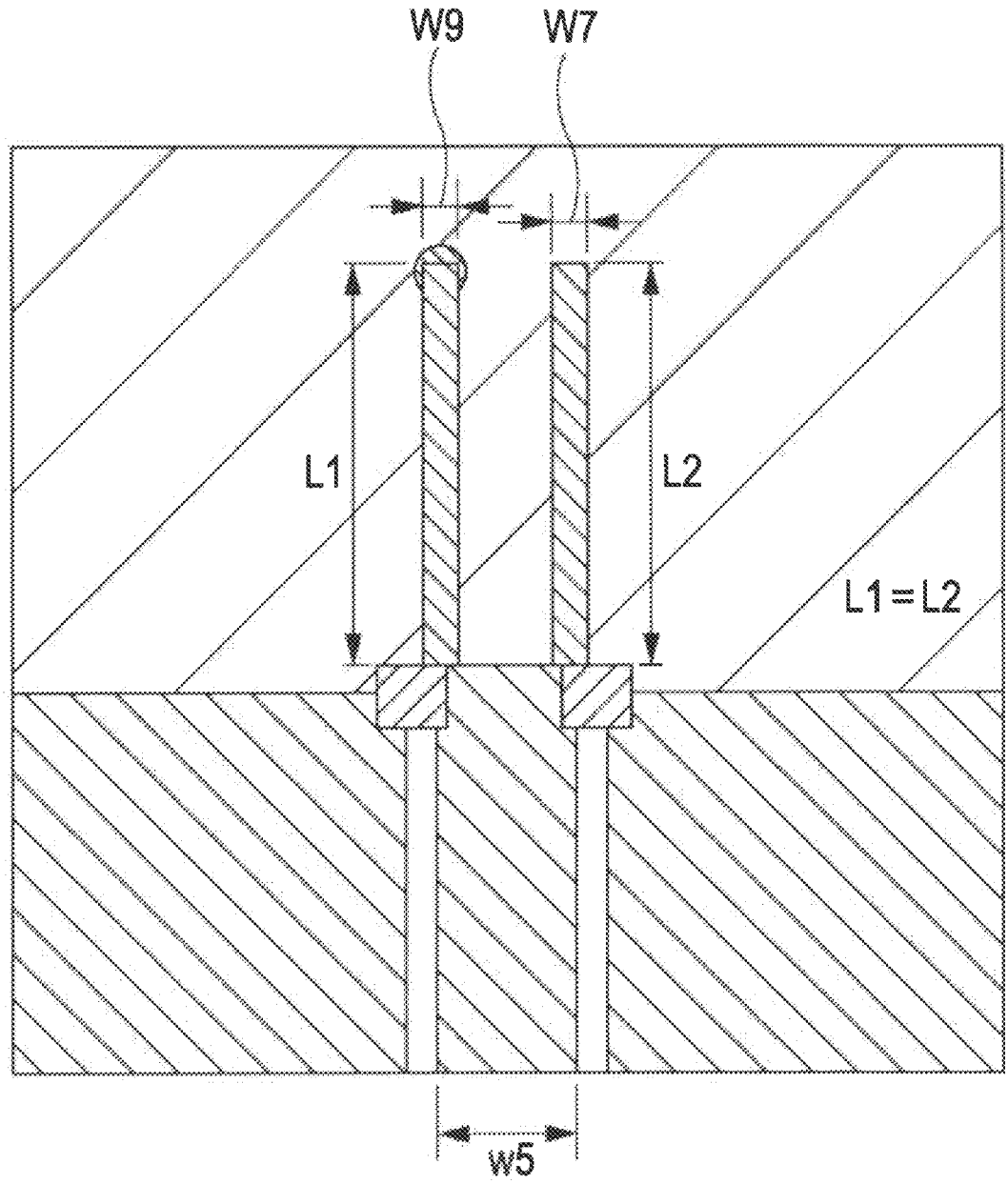
FIG. 6 is a diagram illustrating respective components of the planar antenna illustrated in FIG. 1, together with the sizes thereof.

With reference to FIG. 6 showing the sizes of the respective components of the planar antenna illustrated in FIG. 1, specific description will be added to the above description.

A length L1 and a width W9 of the radiating element 308 functioning as the ground end are respectively set to be equal to a length L2 and a width W7 of the radiating element 307 functioning as the open end. Then, the two radiating elements 308 and 307 are disposed to be apart from each other by a width w5, and are connected to the feeder line 301 via the resistors 305 and 306, respectively.

The respective lengths L1 and L2 (=L) of the radiating elements 308 and 307 are selected such that the following Equation (5) holds.

$$0 < L < \frac{\lambda_g}{4} \quad (5)$$

The value $\lambda_g/4$ is set to be the lowest frequency desired to be transmitted.

Further, the respective widths W7 and W9 (=W) of the radiating elements 307 and 308 can be selected such that the following Equation (6) holds.

$$w_{137} \le W < \frac{w5}{2} \quad (6)$$

In the above Equation (6), $w_{137}$ represents the line width with which the impedance matching is attained in the planar antenna functioning as the transmission line, i.e., with which the value of the impedance $Z_{trans}$ of the antenna is approximately 137[Ω] (as previously described).

Therefore, according to the planar antenna illustrated in FIG. 1, the maximum area of the radiating elements is represented as w5×L1. It is desired to be understood that this value is sufficiently smaller than the area W×L of the radiating element of the patch antenna of the related art illustrated in FIGS. 10 and 11.

Figure 7:
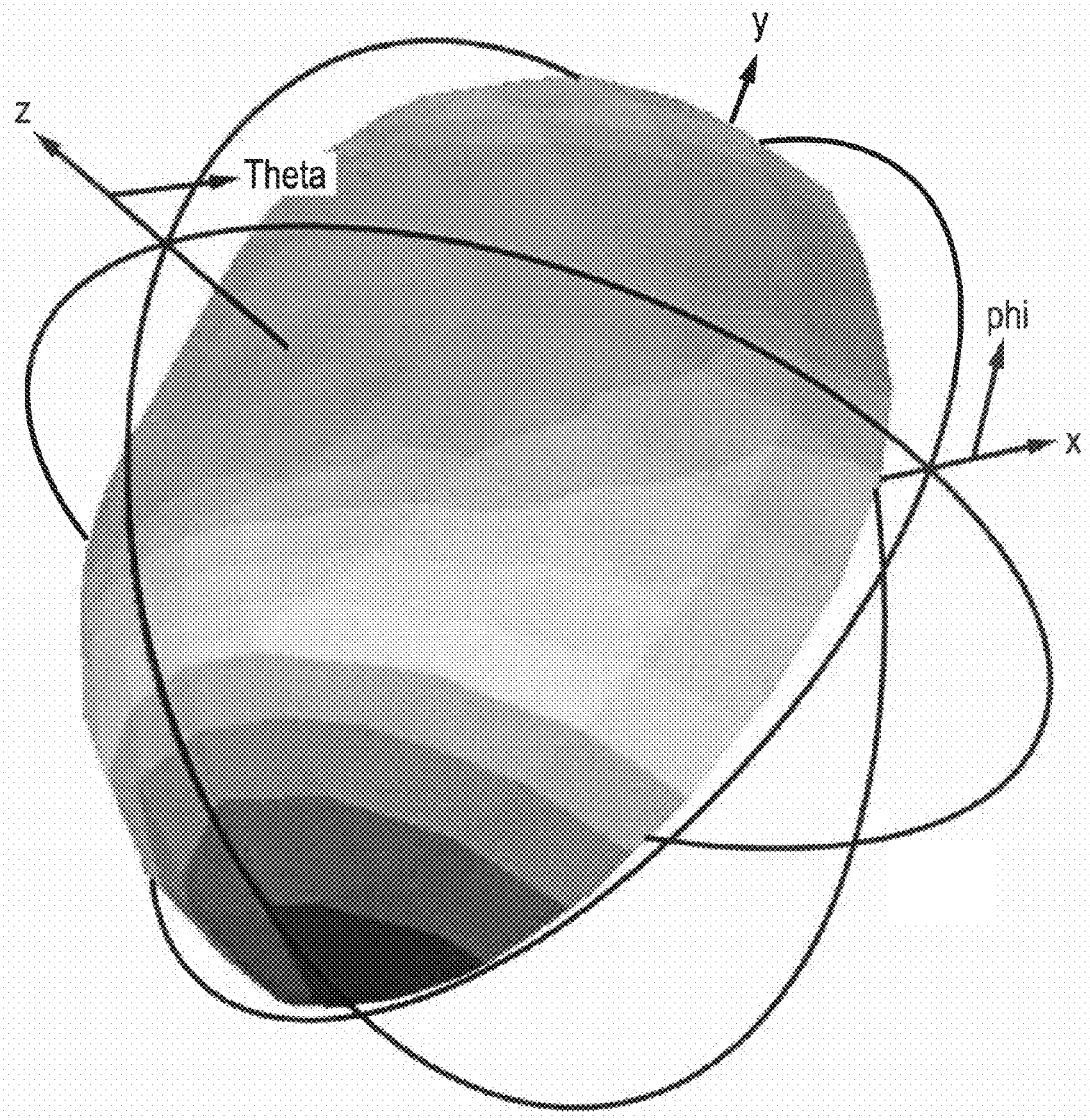
FIG. 7 is a diagram illustrating a simulation result of the radiation of radio waves from the planar antenna illustrated in FIG. 1.

FIG. 7 illustrates a simulation result of the radiation of radio waves from the planar antenna illustrated in FIG. 1. Herein, a surface of a dielectric material 310 is provided with a y-axis in the feeding direction extending along the radiating element 307 and an x-axis in a direction perpendicular to the y-axis, and a z-axis is provided in a normal direction directed upward from the surface.

It is observed in FIG. 7 that the planar antenna illustrated in FIG. 1 has a radiation direction opposite to an incident direction to the radiating element, and thus has directivity backward of the incident direction.

Figure 8:
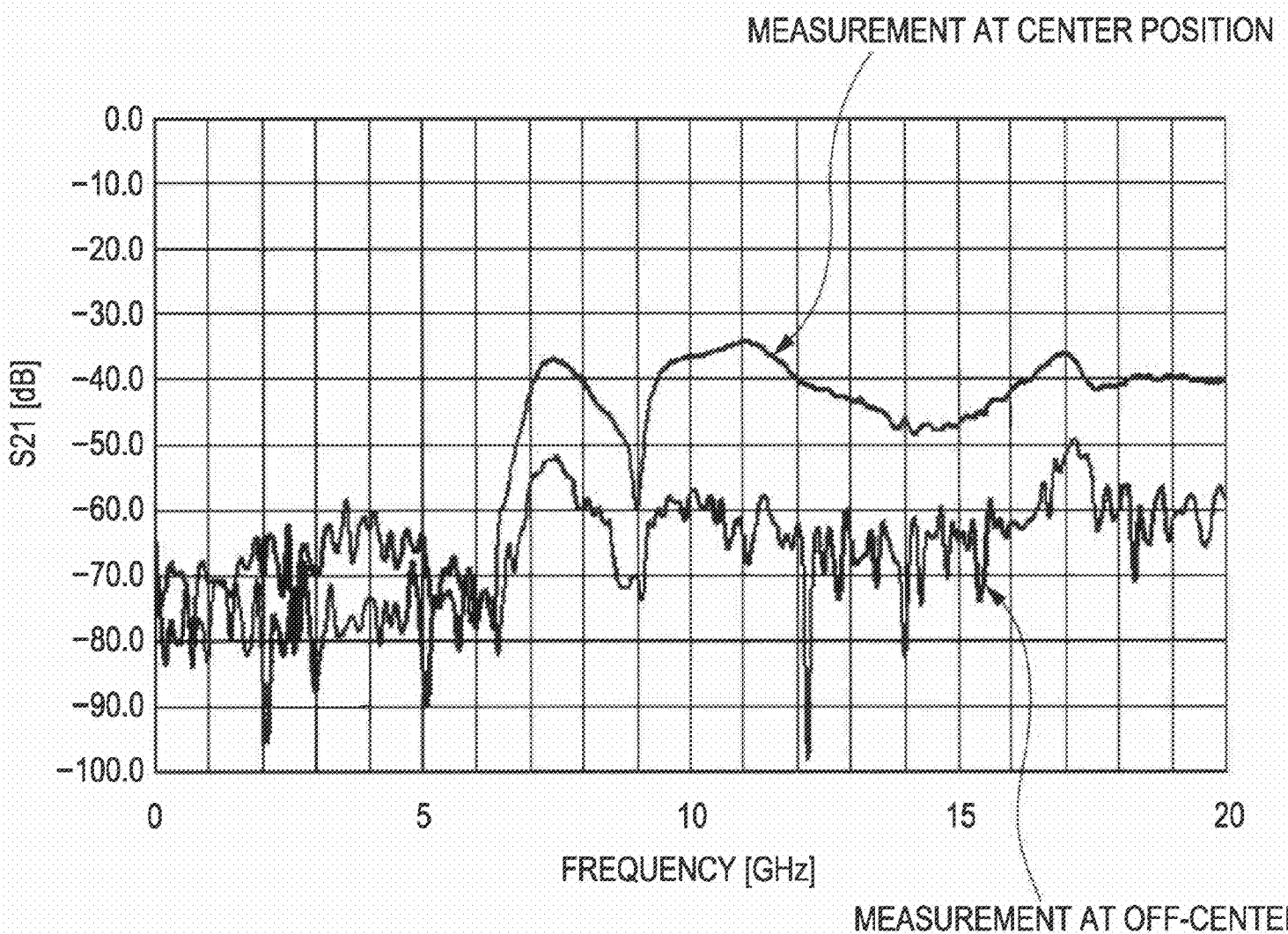
FIG. 8 is a graph illustrating a transmission characteristic of the planar antenna illustrated in FIG. 1.

Further, FIG. 8 illustrates a transmission characteristic S21 of the planar antenna illustrated in FIG. 1. A transmission characteristic is an amount representing how much electric power is transmitted between two disposed antennas (as commonly known).

It is observed in the graph shown in the drawing that the planar antenna can transmit electric power in a band from 7 GHz to 8 GHz, a band from 9.5 GHz to 12 GHz, and a band from 16 GHz to 20 GHz, and thus has a substantially wide band characteristic. The fractional bandwidth of a normal patch antenna is approximately 10%. In contrast, the planar antenna illustrated in FIG. 1 has fractional bandwidths 13%, 23%, and 22% in the band from 7 GHz to 8 GHz, the band from 9.5 GHz to 12 GHz, and the band from 16 GHz to 20 GHz, respectively. Therefore, it can be said that the band of the planar antenna is substantially wide.

Further, FIG. 8 illustrates the characteristic obtained when the antenna is disposed in the direction of the directivity (i.e., in a −y direction) and the characteristic obtained when the antenna is disposed to deviate from the direction of the directivity (i.e., in a −y direction with offset in a z direction). For example, a difference in the value between the antenna disposition in the direction of the directivity and the antenna disposition deviating from the direction of the directivity is observed around the frequency of 10 GHz. This result also shows that the planar antenna has the directivity direction, and that the directivity affects the transmission characteristic.

Figure 9A:
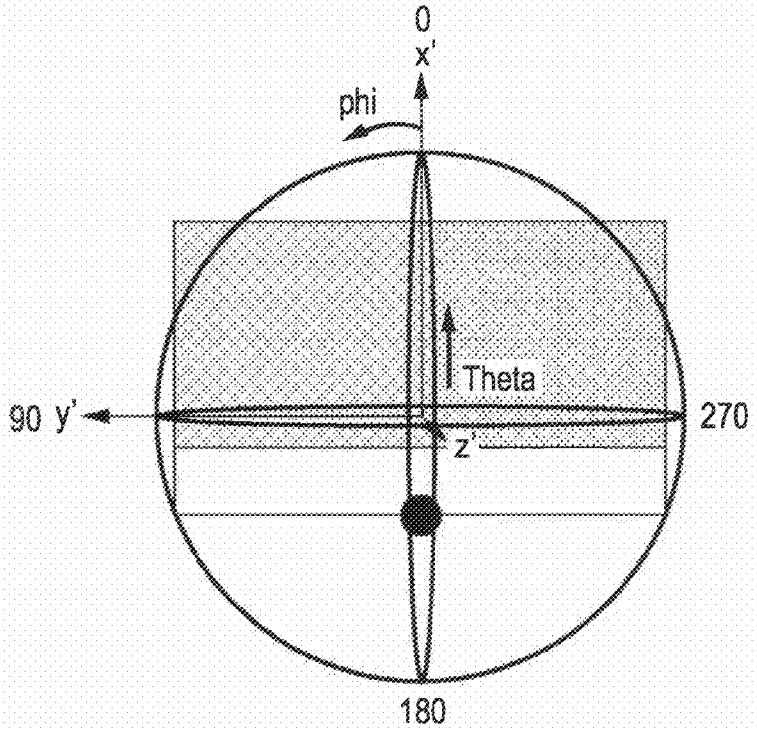
FIGS. 9A and 9B are diagrams showing an antenna disposition view and a directivity graph of the planar antenna illustrated in FIG. 1.
Figure 9B:
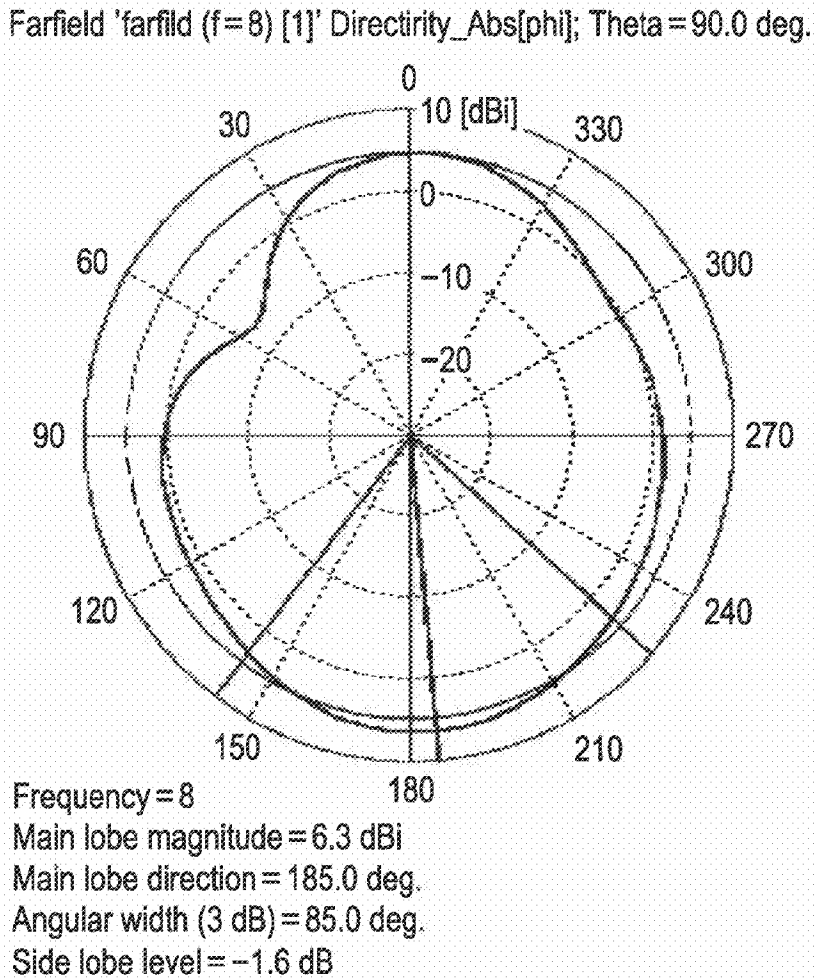

Further, FIG. 9A shows an antenna disposition view of the planar antenna illustrated in FIG. 1, and FIG. 9B shows a graph illustrating the directivity of the planar antenna in the antenna disposition illustrated in FIG. 9A.

In a plane defined by x'- and y'-axes shown in FIG. 9A and having a z'-axis as a perpendicular (see the antenna disposition view), it is assumed that the rotation occurs in the direction of Phi, and that +x', +y', −x', and −y' are represented as 0 degrees, 90 degrees, 180 degrees, and 270 degrees, respectively. The directivity graph of FIG. 9B shows a main lobe located at 185 degrees and a half-value angle (an angular width at 3 dB) of 85 degrees.

It should be understood by those skilled in the art that various modifications, combinations, sub-combinations and alterations may occur depending on design requirements and other factors insofar as they are within the scope of the appended claims or the equivalents thereof.

What is claimed is:

1. A planar antenna device mounted on a board including a dielectric layer and upper and lower conductor layers vertically sandwiching the dielectric layer, the upper conductor layer comprising:

a first radiating element having an end portion connected through a via hole to a ground formed by the lower conductor layer;

a second radiating element having an open end portion;

first and second ground conductors connected to respective base portions of the first and second radiating elements via resistors; and a feeder line configured to feed power to the first and second radiating elements.

2. The antenna device according to claim 1, wherein a length L of each of the first and second radiating elements is less than one quarter of an effective wavelength $\lambda_g$, and wherein a line width W of each of the first and second radiating elements is equal to or greater than a line width $w_{137}$ with which the impedance of an inductance-capacitance resonant circuit formed by the first and second radiating elements is approximately 137[Ω].

3. The antenna device according to claim 1, wherein the first and second radiating elements are connected to the feeder line via the resistors each having an appropriate resistance value in consideration of the impedance of the feeder line.

* * * * *